United States Patent [19]

Kling

[11] Patent Number: 4,837,483

[45] Date of Patent: Jun. 6, 1989

[54] GLOW DISCHARGE STARTER CONTAINING BORON

[75] Inventor: Michael R. Kling, Williamsport, Pa.

[73] Assignee: GTE Products Corporation, Danvers, Mass.

[21] Appl. No.: 181,345

[22] Filed: Apr. 14, 1988

[51] Int. Cl.[4] ..... H01J 17/24; H01J 61/64

[52] U.S. Cl. ..... 313/619; 313/558; 252/181.6; 420/416; 337/22

[58] Field of Search ..... 313/619, 558, 559, 549, 313/620–622; 252/181.6; 420/416; 337/22–27

[56] References Cited

U.S. PATENT DOCUMENTS 1,023,208 4/1912 Lesmuller ..... 420/416

4,646,050 2/1987 Kling et al. ..... 337/22

*Primary Examiner*—David K. Moore

*Assistant Examiner*—Michael Horabik

*Attorney, Agent, or Firm*—Carlo S. Bessone

[57] ABSTRACT

A glow discharge starter having an hermetically sealed envelope of vitreous material, a seal located at one end thereof and containing an ionizable medium. A pair of electrical conductors extend through the seal and terminate in a spaced relationship to form a pair of electrodes within the envelope. At least one of the electrodes has a bimetallic element secured thereto. A coating comprising lanthanum, nickel and boron is disposed on a surface within the envelope. Preferably, the coating comprises from about 2 percent to about 4 percent boron. The coating is effective in improving the aging efficiency and the temperature stability of the glow discharge starter.

10 Claims, 1 Drawing Sheet

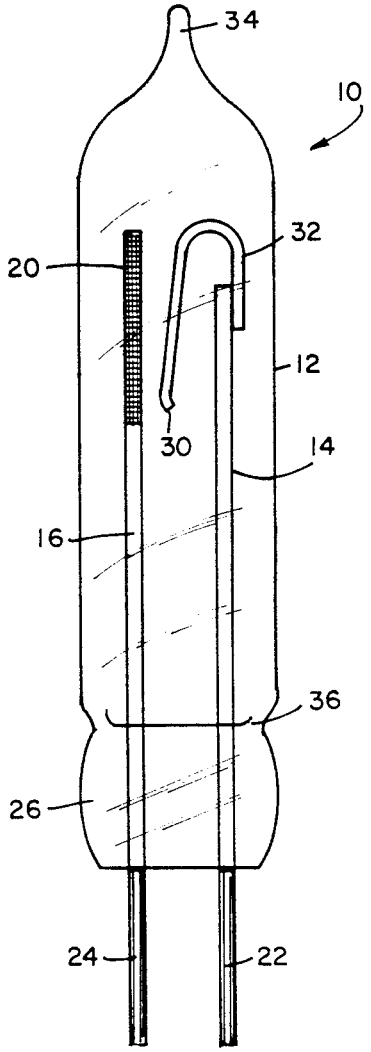
34
10
32
20
12
30
14
16
36
26
24
22

GLOW DISCHARGE STARTER CONTAINING BORON

TECHNICAL FIELD

This invention relates in general to glow discharge starters for arc discharge lamps and, more particularly, to an improved glow discharge starter containing a lanthanum-nickel alloy doped with an oxidation resistant element.

BACKGROUND OF THE INVENTION

Glow discharge starters comprise an hermetically sealed envelope containing an ionizable medium and a pair of normally spaced-apart electrodes, at least one of which is a thermally responsive bimetallic electrode. The pressure of the gas, the spacing of the electrodes and the characteristics of the other electrically conducting elements of the starter are selected so that on application of a predetermined voltage across the starter, known as the breakdown voltage, a glow discharge occurs between the starter electrodes.

Such glow discharge starters are used extensively for starting preheat fluorescent lamps and similar gaseous electrical discharge devices having electrodes which require heating prior to starting. The lamp circuit generally includes a ballast transformer which serves to limit the current through the lamp connected in its output circuit. The starter is connected in shunt with the discharge path through the lamp and in series with the electrodes; for instance, one terminal of each electrode of the lamp is connected to the output circuit of the ballast and the other terminal of each electrode is connected across the starter. At starting, the open circuit voltage of the ballast exceeds the breakdown voltage of the starter and starts a glow discharge therein which heats the thermally responsive electrode and causes it to engage the other electrode in the starter. The closure of the starter effectively short circuits the lamp electrodes in series across the ballast; thereupon the increased current flow through the electrodes raises them rapidly to an electrode emitting temperature. Simultaneously, the glow discharge through the starter is extinguished and the switch electrodes begin to cool. After a time, the thermally responsive electrode in the starter disengages itself from the stationary electrode and the heating circuit is thereby opened. A transient voltage surge or kick then occurs due to the inductance in the ballast. This surge impressed across the lamp normally starts the main discharge between the lamp electrodes; if the lamp fails to start, this cycle is repeated until starting is achieved. After the main discharge through the lamp has started, the voltage drop thereacross is less than the breakdown voltage of the starter so that the starter does not develop a glow discharge and its electrodes remain disengaged.

A glow discharge starter of the aforementioned type is shown and described, for example, in the book "IES Lighting Handbook, 1981 Reference Volume", pages 8–35 and 8–36.

Glow discharge starters intended for operation on a 110–120 volt commercial circuit require the addition of a quantity of a low electron work function material in order to lower the breakdown voltage of the glow discharge. Several methods are known for reducing the breakdown voltage. For example, U.S. Pat. No. 4,562,379, which issued to Dobashi et al, discloses the use of a film deposited on the inner surface of the envelope and formed of a mixture of metal barium and metal oxide. U.S. Pat. No. 2,740,861, which issued to Lake on Apr. 3, 1956, discloses coating the electrodes with zinc to lower the breakdown voltage of the glow discharge starter.

Some commercially available glow discharge starters employ a coating of a lanthanum-nickel alloy on one of the electrodes. The lanthanum-nickel alloy provides a low work function emissive material necessary to obtain the required breakdown voltage. The lanthanum also acts to getter contaminants, such as oxygen, from the fill gas. However, the lanthanum-nickel alloy, which is effective in providing the desired results, is very reactive to air and tends to oxidize at room temperature. Since the effect is greatly accelerated at the melting temperature achieved during the coating application of the molten alloy to the electrode (e.g., 485° C.), the alloy must be maintained under an inert atmosphere, such as argon. Also, exposure of the lanthanum-nickel alloy to air must be kept to a minimum after the coating process. The freshly coated surfaces begin to oxidize immediately and thereby affecting the performance of the glow discharge starter.

SUMMARY OF THE INVENTION

It is, therefore, an object of the invention to obviate the disadvantages of the prior art.

It is another object of the invention to provide an alternative alloy for lowering the breakdown voltage of glow discharge starters.

It is still another object of the invention to provide a means for reducing the oxidation of a lanthanum-nickel alloy used in the manufacture of glow discharge starters.

It is still another object of the invention to provide a glow discharge starter having improved aging efficiency and temperature stability.

These objects are accomplished, in one aspect of the invention, by the provision of a glow discharge starter comprising an hermetically sealed envelope of vitreous material having a seal located at one end thereof and containing an ionizable medium. A pair of electrical conductors extend through the seal and terminate in a spaced relationship to form a pair of electrodes within the envelope. At least one of the electrodes has a bimetallic element secured thereto. The bimetallic element is deformable by heat into engagement with the other electrode. A coating comprising lanthanum, nickel and boron is disposed on a surface within the envelope.

In accordance with further aspects of the present invention, the glow discharge starter includes a bimetallic electrode and a counter electrode and the coating is disposed on a portion of the counter electrode. The coating comprises about 0.5 percent to about 10 percent of boron. In a preferred embodiment, the coating comprises about 83.3 percent lanthanum, about 14.7 percent nickel and about 2.0 percent boron.

In accordance wih additional aspects of the invention, an alloy comprising by weight about 83.3 percent lanthanum, about 14.7 percent nickel and about 2.0 percent boron is provided.

BRIEF DESCRIPTION OF THE DRAWING

The sole FIGURE is a front elevational view of an embodiment of a glow discharge starter according to the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity there is shown in the sole FIGURE a glow discharge starter 10 in accordance with one embodiment of the invention. Glow discharge starter 10 is shown comprising an hermetically sealed envelope 12 containing an ionizable medium of, for example, argon, helium and mixtures thereof at a pressure of from about 15 to 20 millimeters of mercury.

Preferably, envelope 12 has a wall thickness in the range of from about 0.015 inch (0.380 millimeter) to less than about 0.025 inch (0.635 millimeter). Envelope 12 can be made from, for example, G-10 lead glass, G-12 lead glass or lime glass. The above-mentioned glasses are available from Corning Glass Works, Corning, N.Y. A seal 26 (e.g., press seal) is located at one end of envelope 12. An exhaust tip 34 is located at the other end of envelope 12.

A pair of electrical conductors 22 and 24 (e.g., non-segmented) extend through seal 26 and terminate in a spaced relationship to form a pair of electrodes 14 and 16, respectively, within envelope 12. A suitable material for electrical conductors 22 and 24 (and corresponding electrode post 14 and electrode 16) is a nickel-iron alloy, such as Niron 52 available from GTE Precision Materials Group, Warren, Penna. Alternatively, the electrical conductors may consist of a nickel-iron alloy core sheathed in a copper shell. An example of such a material is sold under the trade name "Dume" and consists of a nickel-iron core having a copper sleeve. The copper sleeve constitutes 21 to 25 percent of the total weight of the material and is usually affixed about the nickel-iron core by swagging, welding, molten dipping, etc. Such wire is especially effective for developing glass-to-metal seals. Generally, heat is applied to the glass and to the "Dumet" which, in turn serves as a bridge between the metal and the glass and insures the desired glass-to-metal seal. Alternatively, electrical conductors 22 and 24 may comprise a nickel-iron alloy core sheathed in a copper shell plated with an electrically conductive material selected from the group consisting of nickel, platinum and rhodium. Specifically, nickel-plated "Dumet" wire, having a diameter in the range of from about 0.010 inch (0.254 millimeter) to about 0.025 inch (0.635 millimeter), is preferred because of the relatively low cost as compared with other metal-plated wires.

Electrode 14 has a bimetallic element 32 secured at one end thereof. Bimetallic element 32 is bent over into a U-shape, as shown in the sole FIGURE, so that the free end 30 thereof is proximate electrode 16. Bimetallic element 32 consists of two strips of metal having different linear coefficients of expansion welded together. The side of higher coefficient of expansion is on the inside curve of the U so that bimetallic element 32, when heated by the glow discharge, opens and engages counter electrode 16. The free end 30 of bimetallic element 32 may be provided with an outwardly projecting embossment or curved portion (not shown) to insure that contact with electrode 16 is always made at the same point after flexure of bimetallic element 32 through a predetermined distance.

Alternatively, electrode 16 can be constructed as a second bimetallic electrode (i.e., have a bimetallic element secured thereto) as shown, for example, in previously mentioned U.S. Pat. No. 2,930,873.

Glow discharge starters are subject to an effect commonly known as dark effect, whereby the breakdown voltage of the glow discharge in the starter is higher in the dark than in the light aftr a period of non-operation. The above-mentioned effect results in delays at starting and erratic operation. Efforts were made to dope a known lanthanum-nickel alloy presently employed in some glow discharge starters with a dopant to improve the dark starting characteristics of the glow discharge starter. Although boron was found to be rather ineffective as a dopant for improving the dark starting characteristics of glow discharge starters, it was discovered that boron surprisingly inhibits the corrosion of the lanthanum-nickel alloy and also improves both aging efficiency and temperature stability of the finished glow discharge starter. Although not fully understood, it is believed that the boron stabilizes the alloy by forming $LaB_6$ and is located interstitially in the crystal lattice.

In accordance with the teachings of the instant invention, glow discharge starter 10 further includes a coating 20 disposed on a surface within envelope 12. Coating 20, which comprises lanthanum, nickel and an oxidation resisting dopant, can be located, for example, on a portion of the internal wall of the envelope or on a portion of at least one of the electrodes. In the sole FIGURE, coating 20 is shown covering a portion of counter electrode 16. Alternatively, the coating can be applied to electrode 14, bimetallic element 32 or to the internal surface of envelope 12. Preferably, the oxidation resisting dopant is boron. The lanthanum-nickel alloy may contain as much as 10 percent boron. Preferably, the boron is about 2 percent to about 4 percent of the total lanthanum-nickel alloy. The alloy contains from about 5.0 percent to about 20.0 percent by weight nickel.

In a typical but non-limitative example of a glow discharge starter made in accordance with the invention, the envelope 12 was made from G-12 lead glass having a wall thickness of about 0.015 inch (0.406 millimeter) and an outside diameter of approximately 0.175 inch (4.445 millimeters). A pair of nickel-plated "Dumet" electrical conductors 22, 24 with a diameter of approximately 0.020 inch (0.508 millimeter) extend through a press seal 26 located at one end of the envelope and terminate within the envelope to form a pair of electrodes 14, 16. The substantially parallel electrodes are spaced approximately 0.060 inch (1.524 millimeters) from each other. The distance from exhaust tip 34 to the top 36 of stem press 26 was approximately 0.660 inch (16.764 millimeters). A bimetallic element 32 having a width of approximately 0.063 inch (1.6 millimeters), an overall length of approximately 0.320 inch (8.128 millimeters) and a thickness of approximately 0.004 inch (0.102 millimeter) was bent over into a U-shape and welded to electrode 14 within envelope 12. A suitable material for bimetallic element 32 is designated as type B1 and is available from Texas Instruments, Attleboro, Mass. A portion of the other electrode 16 was dipped in a molten alloy having a composition about 83.3 percent lanthanum, 14.7 percent nickel and 2.0 percent boron. The alloy was prepared by Johnson Mathey/Aesar Group located at Eagles Landing, P.O. Box 1087, Seabrook, N.H. 03874. Approximately 2 milligrams of the alloy was used to coat a portion of electrode 16. Envelope 12 contained an ionizable medium of 25 percent helium—75 percent argon at a pressure of approximately 18 millimeters of mercury. The glow discharge starter 10 displaced a volume of approximately 0.25 cubic centimeters.

Samples of the above glow discharge starters were subjected to various treatments and subsequently tested for successful aging and survival at high temperatures. In groups 1 and 2 below, the coatings were subjected to the atmosphere for 24 hours prior to evacuation of the starter envelopes. In groups 3 and 4 below, the coatings had minimum exposure to the atmosphere (i.e., less than 15 minutes). Groups 5 and 6 were subjected to bake temperatures greater than 300° C. for 5 minutes prior to aging. Aging was accomplished by applying 1000 volts D.C. for one minute, followed by 110 volts A.C. for one minute. TABLE I below shows the percent of glow discharge starters which operated successfully after aging. The percent of starters which operated successfully after being heated for 15 minutes at 200° C. is also shown in TABLE I.

TABLE I

| Group | Coating | % After Aging | % After 15 mins. at 200° C. |
|---|---|---|---|
| 1 | La—Ni, 24 hrs. in air | 0 | 0 |
| 2 | La—Ni—B, 24 hrs. in air | 96 | 43 |
| 3 | La—Ni, min. air exp. | 92 | 0 |
| 4 | La—Ni—B, min. air exp. | 100 | 33 |
| 5 | La—Ni, >300° C Bake | 92 | 18 |
| 6 | La—Ni—B, >300 C. Bake | 92 | 91 |

TABLE I above clearly shows that the addition of boron to the lanthanum-nickel alloy improves both aging efficiency and temperature stability of the finished glow discharge starter.

It has been discovered that lanthanum-nickel alloy doped with a small amount of boron is resistant to oxidation. This provides two benefits to the manufacture of glow discharge starters. First, the getter material itself can be stored for an extended period of time, while the normal alloy has a limited shelf life. This corrosion resistance is especially important for material left in the dip pot when the machine and argon flow are shut off. Second, the new alloy also provides improved glow switch performance by reducing the amount of oxide formed on the emissive surface between the time the lead is dipped and the time the envelope is evacuated. Less oxide results in improved aging and more stable performance during storage.

The ternary alloy of lanthanum, nickel and boron may be useful in areas other than in glow discharge startres. For example, tha alloy may be useful in hydrogen storage technology. A more stable alloy may be a better substrate for the metallic hydride.

While there have been shown and described what are at present considered to be the preferred embodiments of the invention, it will be apparent to those skilled in the art that various changes and modifications can be made herein without departing from the scope of the invention. The embodiments shown in the sole FIGURE and described in the specification are intended to best explain the principles of the invention and its practical application to hereby enable others in the art to best utilize the invention in various embodiments and with various modification as are suited to the particular use contemplated.

What is claimed is:

1. A glow discharge starter comprising:

an hermetically sealed envelope of vitreous material having a seal located at one end thereof and containing an ionizable medium; a pair of electrical conductors extending through said seal and terminating in a spaced relationship to form a pair of electrodes within said envelope, at least one of said electrodes having a bimetallic element secured thereto, said bimetallic element being deformable by heat into engagement with the other of said electrodes; and a coating comprising lanthanum, nickel and boron disposed on a surface within said envelope.

2. The glow discharge starter of claim 1 wherein said coating is disposed on a portion of at least one of said electrodes.

3. The glow discharge starter of claim 1 wherein said glow discharge starter includes a bimetallic electrode and a counter electrode and said coating is disposed on a portion of said counter electrode.

4. The glow discharge starter of claim 1 wherein said coating comprises from about 0.5 percent to about 10 percent of said boron.

5. The glow discharge starter of claim 1 wherein said coating comprises about 2 percent of said boron.

6. The glow discharge starter of claim 1 wherein said coating comprises about 83.3 percent lanthanum, about 14.7 percent nickel and about 2.0 percent boron.

7. A glow discharge starter comprising:

an hermetically sealed envelope of vitreous material having a seal located at one end thereof and containing an ionizable medium; a pair of electrical conductors exending through said seal and terminating in a spaced relationship to form a pair of electrodes within said envelope, said electrodes including a bimetallic electrode having a bimetallic element secured thereto and a counter electrode, said bimetallic element being deformable by heat into engagement with said counter electrode; and a coating comprising lanthanum, nickel and boron disposed on a portion of said counter electrode, said coating comprises from about 0.5 percent to about 10 percent of said boron.

8. The glow discharge starter of claim 7 wherein said coating comprises about 2 percent of said boron.

9. The glow discharge starter of claim 7 wherein said coating comprises about 83.3 percent lanthanum, about 14.7 percent nickel and about 2.0 percent boron.

10. An alloy comprising by eight about 83.3 percent lanthanum, about 14.7 percent nickel and about 2.0 percent boron.

* * * * *